United States Patent [19]

Plunk

[11] Patent Number: 5,072,988

[45] Date of Patent: Dec. 17, 1991

[54] WALL PROXIMITY CHAIR

[75] Inventor: Jeffrey L. Plunk, Pontotoc, Miss.

[73] Assignee: Super Sagless Corporation, Tupelo, Miss.

[21] Appl. No.: 303,650

[22] Filed: Jan. 27, 1989

Related U.S. Application Data

[63] Continuation of Ser. No. 60,032, Jun. 9, 1987.

[51] Int. Cl.[5] ..... A47C 1/02

[52] U.S. Cl. ..... 257/68; 297/85

[58] Field of Search ..... 297/85, 68, 84, 83, 297/329

[56] References Cited

U.S. PATENT DOCUMENTS

| | | | |
|---|---|---|---|
| 3,758,151 | 9/1973 | Re | 297/329 |
| 4,108,491 | 8/1978 | Rogers, Jr. | 297/85 |
| 4,216,992 | 8/1980 | Crum | 297/85 |
| 4,226,469 | 10/1980 | Rogers, Jr. et al. | 297/85 |
| 4,249,772 | 2/1981 | Rogers, Jr. | 297/68 |
| 4,306,746 | 12/1981 | Crum | 297/85 |
| 4,332,417 | 6/1982 | Mizelle | 297/329 |
| 4,531,778 | 7/1985 | Rogers, Jr. | 297/85 |

*Primary Examiner*—Peter A. Aschenbrenner

*Attorney, Agent, or Firm*—Wolf, Greenfield & Sacks

[57] ABSTRACT

A three-position reclining chair having a seat and backrest that move relative to one another. The seat and backrest are supported by a mechanism having a seat mounting link carried by swing links suspended from a support link in turn carried by pivot links mounted on a roller link. The roller link moves fore and aft on fixed tracks mounted on the base. A drive link is connected to one of the pivot links and to a bell crank mounted on the roller link. The bell crank is also attached at one end to the base. A handle actuating assembly is also connected to one of pivot links. Actuation of the handle drives the roller link forward on the base and simultaneously moves the pivot links over center so that the occupant's weight moves the seat to the intermediate reclining position. To move to the fully reclined position the occupant pushes against the arms of the chair which moves the swing links and seat mounting link further forward and tilts the backrest rearwardly.

22 Claims, 6 Drawing Sheets

WALL PROXIMITY CHAIR

This application is a continuation of application Ser. No. 07/060032, filed Jun. 9, 1987.

This invention relates to reclining chairs and more particularly relates to three-position recliners which may be placed in close proximity to a wall or other furniture without interference when the chair is reclined.

Reclining chairs have enjoyed great popularity for many years. Literally millions of reclining chairs have been sold.

The early reclining chairs required that they be placed several feet from the wall or other furniture in order to enable the backrest to recline fully without interference. Many of the early reclining chairs had fixed arms, and to move the chairs to a reclining position, the occupant would push against the arms so as to force his or her body against the backrest. In that type of chair, the reclining action was achieved by moving the seat and backrest rearwardly with respect to the chair arms, which, of course, moved the backrest toward the wall.

In the late 1960s and 1970s, particularly as housing units became smaller, the chair manufacturers sought ways to modify the chair construction to enable them to be placed closer to the wall without interference from the wall as the chair moved to a reclining position. Examples of some those chairs are shown in U.S. Pat. Nos. 3,874,724; 4,077,663; 4,099,776; 4,153,292; 4,195,878 and 4,202,580. Many of these first generation of wall proximity chairs employed long tracks on which the entire chair including the base and frame moved forwardly as the back tilted rearwardly toward the wall in response to pressure against the arms. The entire chair assembly including the base and frame moved forwardly on the tracks away from the wall to compensate for the rearward tilting of the backrest. Some of those arrangements included tracks of 12 inches or more. The long travel path of the entire chair base and frame on the tracks particularly during the reclining action created a feeling of instability for the occupant, which many people found unacceptable.

In seeking to improve the styling of reclining chairs, manufacturers sought ways, for example, to enable T-cushions to be used. This was not possible in chairs in which the seat moved rearwardly with respect to the side arms, because the wings of the T-cushion were engaged by the front of the arm and could not travel rearwardly with the seat frame. Consequently, designers sought ways to reverse the direction of motion of the seat with respect to the frame or alternatively to fix the arms with the seat so that they maintained the same relative positions with respect to one another both in the upright and reclining positions of the chair. Because the arms and seat move together in those chairs, means other than pressing against the chair arms had to be found to actuate the chairs. The wide use of handle operated actuating mechanisms in reclining chairs was the result.

More recent developments in the reclining chair art enable the chairs to be placed closer to the wall. Chair mechanisms including combinations of linkages and tracks reduced the wall clearance required, but the industry continues to look for suitable mechanism which allow reclining chairs to be placed even closer to the wall. The development and manufacture of mechanisms has grown into a separate division within the furniture industry, and at the present time, many manufacturers employ large technical staffs and expend very substantial amounts of time and money in search for improved mechanisms The ability of a mechanism to enable a reclining chair to be placed very close to the wall is by no means the sole criteria of a mechanism's acceptability. The mechanism must, of course, provide a very comfortable relationship between the seat, arms and backrest. It must also require very little effort to operate. The action of the mechanism must be smooth so as not to impart a feeling of instability to the chair user as it moves between the upright and reclining positions. Furthermore, the nature of the industry requires that the manufacturing costs be competitive.

The principal object of the present invention is to provide a linkage mechanism for reclining chairs, which enables a chair in which the mechanism is incorporated to be placed with its backrest within an inch of the wall without incurring any interference from the wall as the chair moves between the upright and reclining positions.

Another object of the present invention is to provide a mechanism having both linkages and tracks, which permits the chair to be placed in very close proximity to the wall and which, nevertheless, reduces the length of roller travel in the mechanism.

Yet another important object of the present invention is to provide a reclining chair mechanism which may be operated almost effortlessly by the chair occupant.

To accomplish these and other object, the mechanism of the present invention incorporates three different motions into the chair. That is, the travel of the seat and side panel assembly has three separate sources. First, a seat mounting link which carries the chair frame is swingably supported on a support link by swing links. The swing links enable the seat mounting link to move fore and aft with respect to the support link. Second, the support link is mounted on pivot links secured to a base link, and the pivot links enable the support link to swing fore and aft with respect to the base link. Third, the base link is in turn movable on the base plate by virtue of a roller and track assembly.

When the chair is moved from an upright position to an intermediate or TV position, the base link advances on the tracks secured to the base plate, and, simultaneously, the support link moves forwardly on its front and rear pivot links with respect to the base link. When the chair moves from the TV position to the fully reclined position, the seat mounting link swings forwardly with respect to the support link so as to move the frame further away from the wall. A handle actuating mechanism is provided to very conveniently enable the chair occupant to extend the footrest and at the same time place the occupant's weight in a position to automatically drive the mechanism to the TV position. Pressure against the backrest when the chair is in the TV position in turn cause the seat mounting link to advance with respect to the support link to achieve the fully reclined position.

These and other objects and features of the present invention will be better understood and appreciated from the following detailed description of one embodiment thereof, selected for purpose of illustration and shown in the accompanying drawings.

BRIEF FIGURE DESCRIPTION

DETAILED DESCRIPTION

Figure 1:
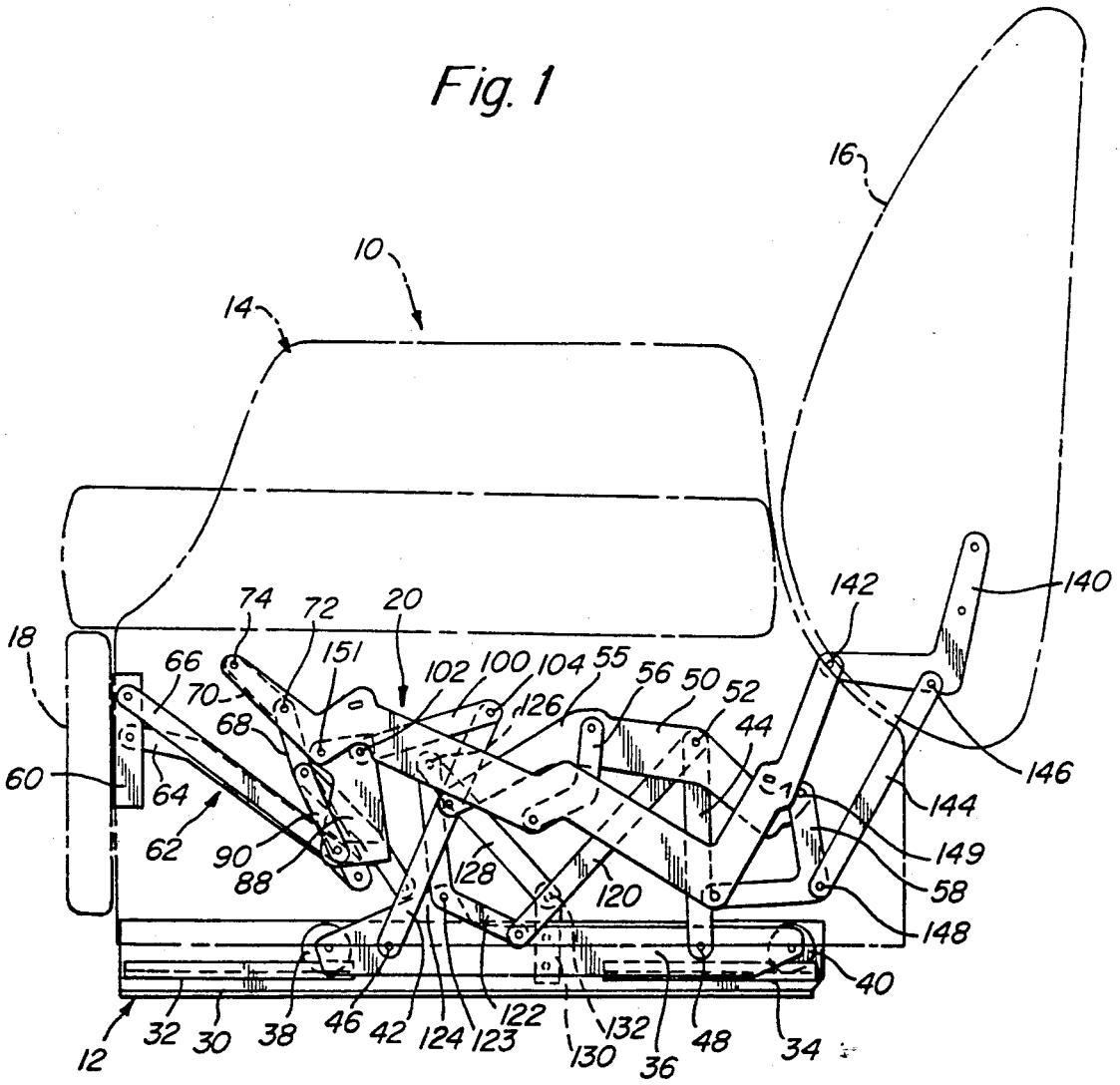
FIG. 1 is a side elevation view of a reclining chair disposed in the upright position and employing the linkage mechanism of this invention.

The present invention is shown embodied in a reclining chair 10 having a base 12, a seat and arm panel assembly 14, a backrest 16 and a footrest 18. The seat and arm panel assembly 14, backrest 16 and footrest 18 are mounted on the base 12 and secured to one another by a pair of linkage mechanisms 20, one on each side of the chair. The two mechanisms are mirror images of one another and only one is described below. The mechanisms 20 enable the chair to move between the upright position shown in FIG. 1, the TV position shown in FIG. 2 and the fully reclined position of FIG. 3, and this may be carried out with the backrest 16 placed just one inch from the wall when the chair is upright.

Figure 4:
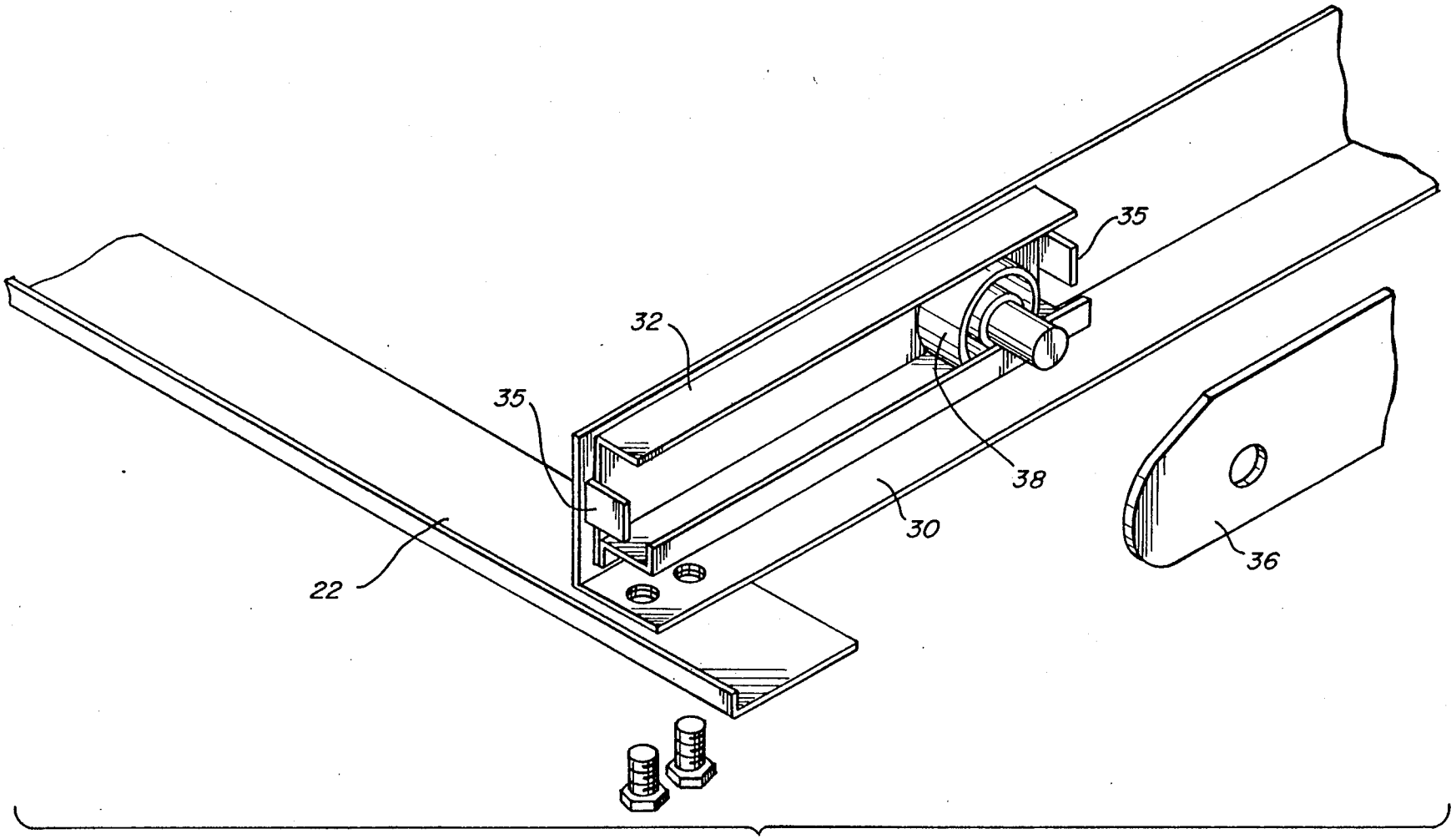
FIG. 4 is a fragmentary perspective view showing the manner in which the base plate is mounted on the base of the chair.

The base 12 shown in FIG. 4 includes a number of cross rails 22 that extend across the width of the chair. (One is shown in FIG. 4.) The linkage mechanisms on each side of the chair are mounted on the cross rails 22. Each linkage mechanism includes a base plate 30 which is bolted to the cross rails 22 and extends front to back on the base. The base plate 30 is formed of a steel angle member, and carries front and rear tracks 32 and 34 on the vertical face of the angle. (Only the front track is shown in FIG. 4.) The tracks 32 and 34 are arranged essentially horizontally, and each is approximately 7 inches long. A roller link 36 carrying front and rear rollers 38 and 40 is supported on the base plate 30 with the rollers disposed in the front and rear tracks 32 and 34, respectively. Safety stops 35 are provided (see FIG. 4) on the ends of the tracks to limit the travel of the roller link 36. The rollers typically are $1\frac{3}{8}$ inches in diameter and connected by rivets to the roller link 36. Travel of the roller link 36 on the tracks 32 and 34 is approximately $5\frac{3}{4}$ inches.

Figure 2:
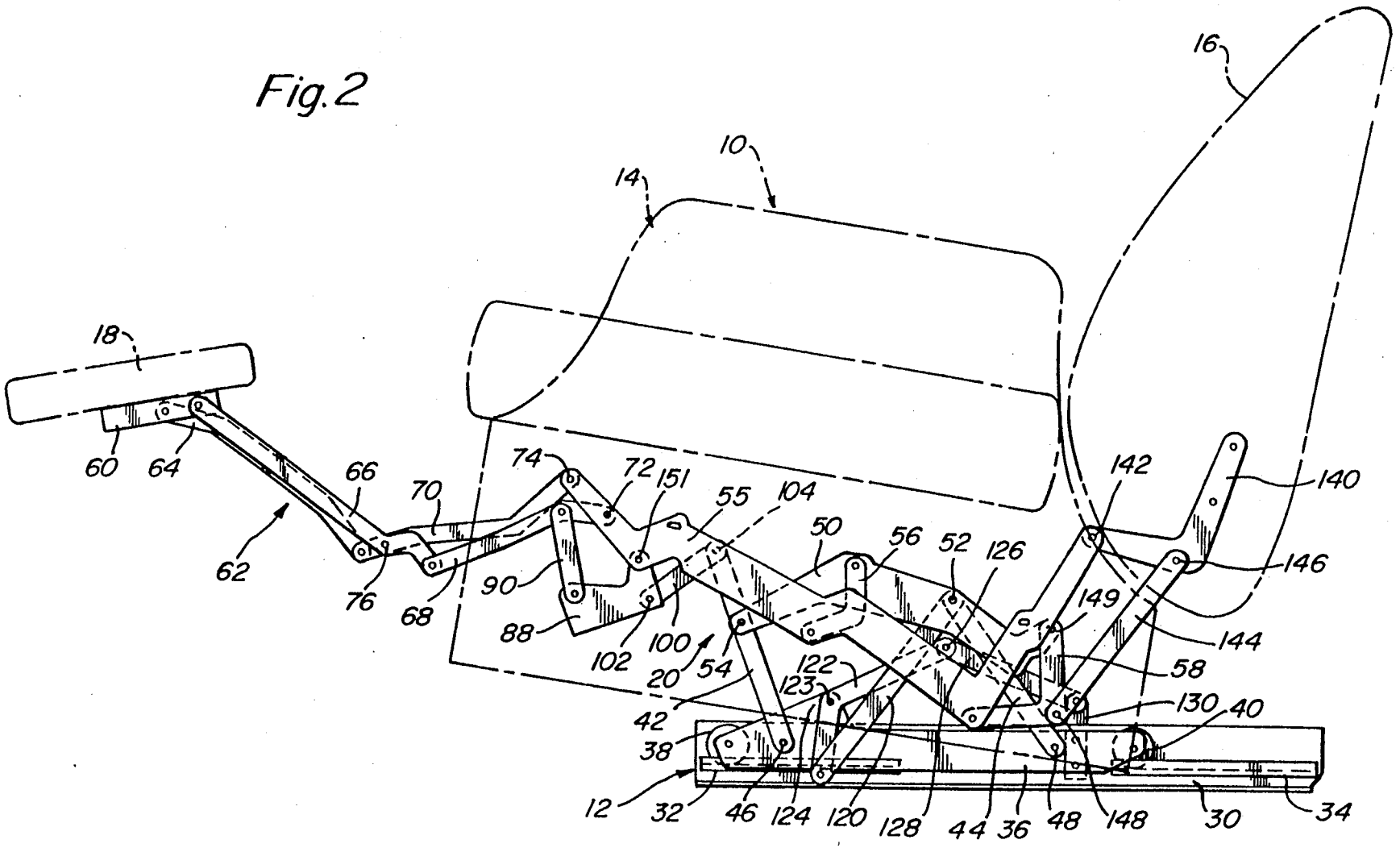
FIG. 2 is a side elevation view similar to FIG. 1 but showing the reclining chair with its mechanism in the intermediate or TV position.
Figure 3:
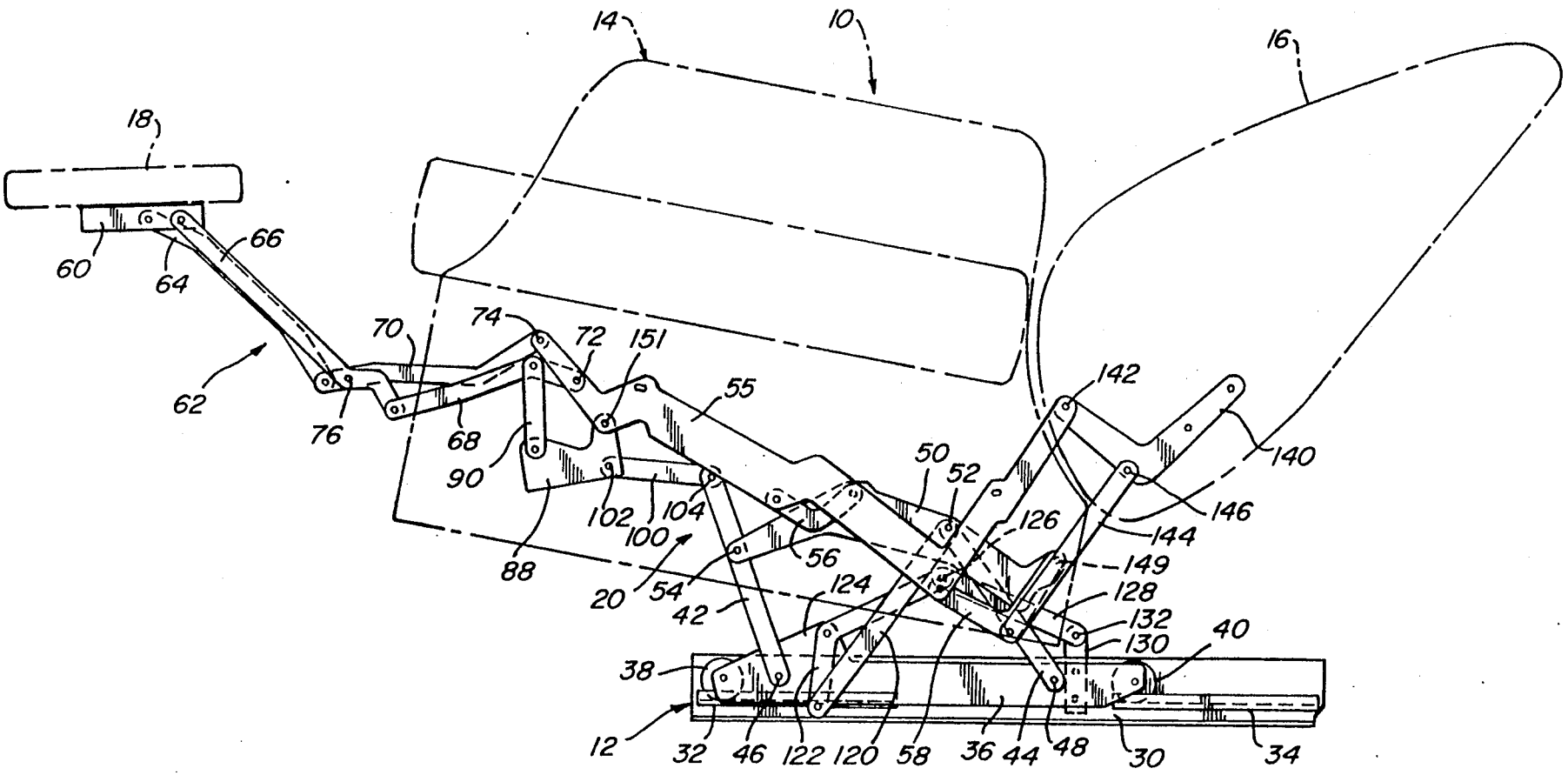
FIG. 3 is a side elevation view similar to FIGS. 1 and 2, but showing the chair in the fully reclined position.

As is clearly shown in FIGS. 1–3, roller link 36 carries front and rear pivot links 42 and 44 secured to the roller link 36 at their lower ends by rivets 46 and 48, respectively. The front and rear pivot links 42 and 44 in turn are connected to and carry a support link 50. The upper end of rear pivot link 44 is connected to the support link by rivet 52 while the front pivot link 42 is connected to the front end of support link 50 by rivet 54 disposed intermediate the ends of the front pivot link (see FIGS. 2 and 3). In the upright position of the chair shown in FIG. 1, the rear pivot link 44 is essentially vertical, while the front pivot link 42 is inclined upwardly and rearwardly from the roller link 36. The roller link 36, front and rear pivot links 42 and 44, and support link 50 together define a four-bar linkage which permits the support link 50 to move forwardly from the position of FIG. 1 to the position of FIGS. 2 and 3 when the chair is moved from upright to TV position. That action is described more fully below. It will be appreciated from an examination of FIG. 1 and the disposition of the front and rear pivot links 42 and 44 that a downwardly directed force on the support link 50 such as is generated by a person sitting in the chair would tend to retain the support link in the position shown. That is, the downwardly directed force would not tend to swing the support link 50 in a forward direction with respect to roller link 36.

The support link 50 carries a seat mounting link 55 on a pair of swing links which are sometimes termed a seat support link 56 and seat drive link 58. The seat mounting link 55 and the swing links 56 and 58 along with the support link 50 also define a four-bar linkage which enables the seat mounting link to move in a swinging motion fore and aft with respect to the support link as is more specifically described below.

The seat mounting link 55 is secured directly to the seat and arm panel assembly 14 and carries that assembly with it as the seat mounting link moves from one to another of the three positions to which it moves as the mechanism is operated.

Footrest 18 is shown in FIGS. 2 and 3 to be mounted on a footrest bracket 60 that in turn is carried by a lazy tong linkage 62 mounted on the forward end of the seat mounting link 55. The lazy tong linkage includes a pair of links 64 and 66 each connected at one end to footrest bracket 60 and at their other ends to the links 68 and 70, respectively. Rivets 72 and 74 pivotally connect the links 68 and 70 to the seat mounting link 55. Lever 70 is also pivotally connected to the link 66 by rivet 76, which causes the lazy tong linkage to act in the conventional manner so as to extend the footrest 18 to the position of FIGS. 2 and 3 when the linkage is open and to retract the footrest 18 to the position of FIG. 1 when the lazy tong linkage is closed.

Figure 5:
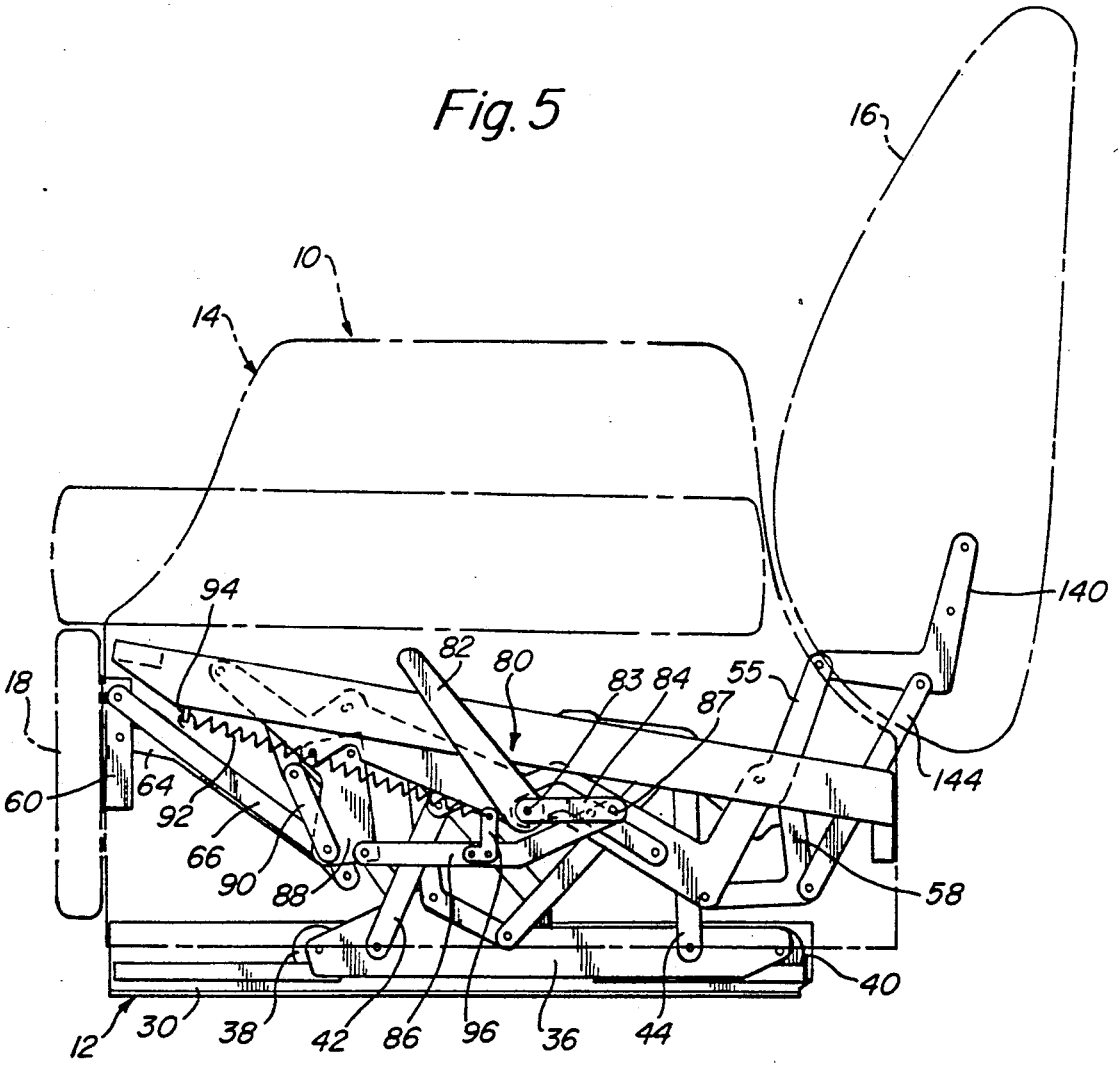
FIG. 5 is a side view of the chair in the upright position and showing the handle actuating subassembly connected to the linkage mechanism.
Figure 6:
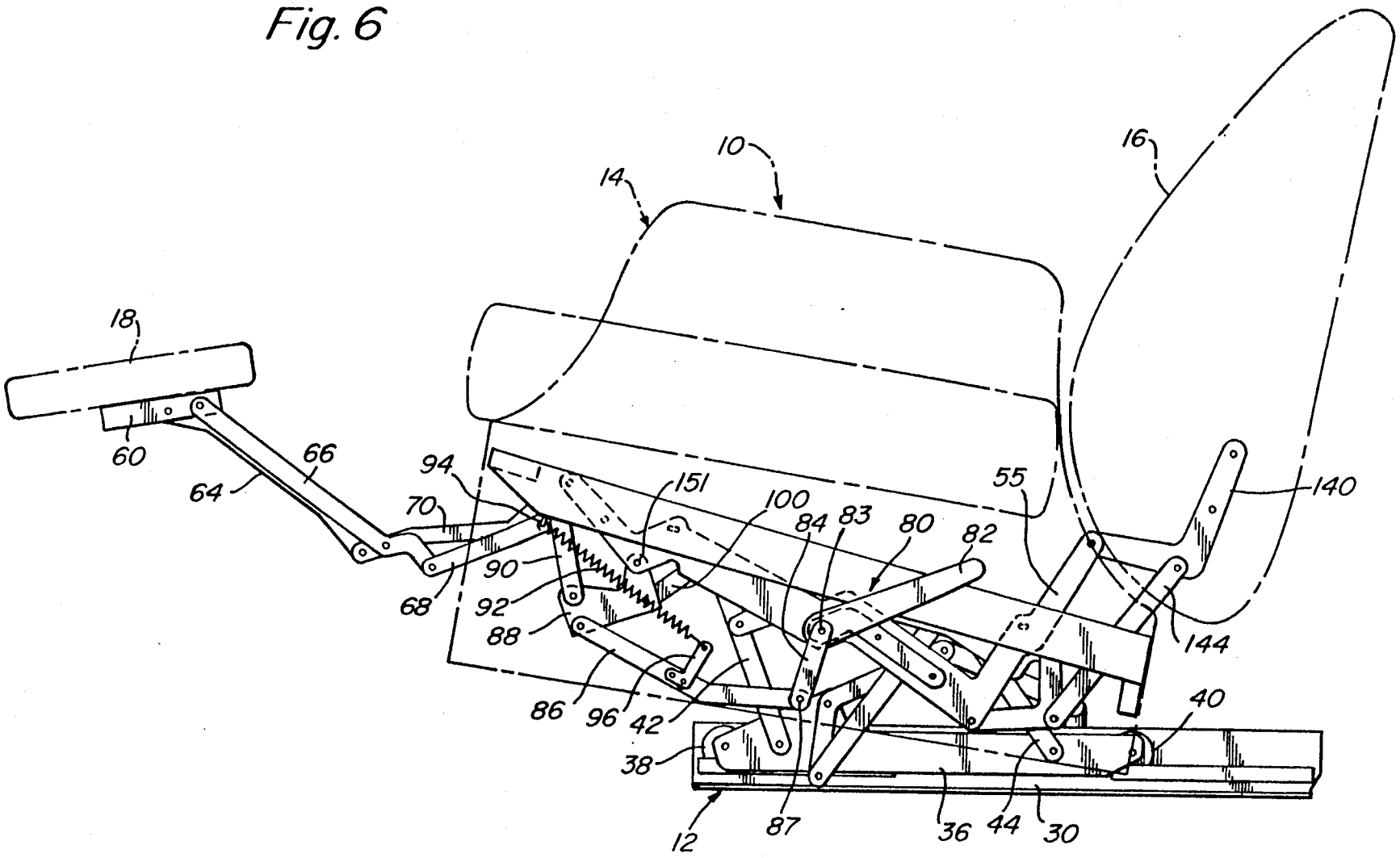
FIG. 6 is side view similar to FIG. 5 but showing the handle actuating subassembly and mechanism in the TV position.

The lazy tong linkage is actuated by a handle assembly 80 shown in FIGS. 5 and 6. The handle assembly 80 includes a handle 82 pivotally mounted on the seat mounting link 55 by pivot pin 83. The handle 82 is keyed to and pivots a first actuating link 84 which in turn is connected to a second actuating link 86 by pin 87. The second actuating link 86 is connected at its forward end a drive transfer link 88, as is clearly showing in FIG. 6. The drive transfer link 88 in turn is connected by a sequencing link 90 to the lazy tong link 68

When the second actuating link 86 moves to the left from the position in FIG. 5 to that of FIG. 6, it pivots the drive transfer link 88 in a clockwise direction which in turn elevates the sequencing link 90 so as to cause the lazy tong linkage to open and elevate footrest 18 (see also FIGS. 2 and 3). This action is assisted by a coil spring 92 extending under tension between an eye 94 on the side panel assembly 14 and a bracket 96 fixed to the second actuating link 86. Spring 92 urges the actuating link 86 to the left, and this in turn causes the action of the drive transfer link 88 and sequencing link 90 described above. As a result, very little force need be applied to handle 82. When the handle pivots clockwise as viewed in FIG. 5 and causes the pin 87 to pass over the axis of spring 92, the spring 92 will immediately take over and provide the force required to elevate the footrest.

A footrest drive link 100 is also pivoted at one end to the drive transfer link 88 by rivet 102 (see FIG. 1 and 3), and its other end is pivoted by means of rivet 104 to the upper end of front pivot link 42. The manner in which the footrest drive link cooperates with the drive transfer link in the movement of the chair between its various positions is described more fully below.

It will be noted in FIGS. 1–3 that the rear pivot link 44 is connected to a drive link 120 which in turn is connected to a bell crank 122 pivoted intermediate its ends to an upstanding bracket 124 integrally formed as part of the roller link 36. The other end of crank 122 in turn is connected by rivet 126 to connecting link 128. From an inspection of FIGS. 1 and 2, it will be appreciated that when the drive link 120 is actuated by the pivotal action of the rear pivot link 44, drive link 120 rotates the bell crank 122 about its pivot 123 on bracket 124 in a clockwise direction, which in turn pushes on the connecting link 128 fixed to base 30, which causes the roller link 36 to move in a forward direction on tracks 32 and 34. The effect of this motion is described more fully below in connection with the operation of the chair.

The chair mechanism is completed by a backrest bracket 140 pivoted by rivet 142 to the rear end of seat mounting link 55. The bracket 140 as is evident in the drawings, supports backrest 16 for pivotal motion with respect to the seat and arm panel assembly 14. The bracket 140 is supported by a back support link 144 connected to it by rivet 146. Link 144 is also connected by rivet 148 to the rear swing link or seat drive link 58. When the backrest is pivoted rearwardly about rivet 142 with respect to the seat and arm panel assembly 14, the back support link 144 pushes the lower portion of the seat drive link 58 in a forward direction causing that link to pivot clockwise about rivet 149, which in turn causes the seat mounting link to swing in a forward direction with respect to the support link.

The chair operates as follows:

An occupant of the chair sitting upright with the chair in the position of FIG. 1 and wishing to recline the chair to the TV position of FIG. 2 or the fully reclined position of FIG. 3 merely pulls the top of handle 82 rearwardly from the position in FIG. 5 to the position of FIG. 6. This action causes the first and second actuator links 84 and 86, respectively to pivot clockwise about the rivet 84 and move toward the front of the chair so as to pivot the drive transfer link 88 from the position of FIGS. 1 and 5 to the position of FIGS. 2 and 6. As the pin 87 passes over the axis of the spring 92, this actuation is assisted by the spring, which serves to draw the second actuator link 86 in a forward direction.

Rotation of the drive transfer link about its pivotal mounting 151 on the seat link does two things. First, it draws the footrest drive link 100 downwardly and to the left from the position of FIG. 1 to the position of FIG. 2 which in turn causes the front pivot link 42 and rear pivot link 44 to move over center. As a result, the downwardly directed force applied by the weight of the occupant causes the support link 50 to move forwardly and downwardly with respect to the roller link 36 and base plate 30 which support it. It also causes the weight of the occupant to push the footrest drive link 100 further downwardly and assist in rotating the transfer link 88 about its pivotal support 151. Second, the pivotal shifting of the drive transfer plate 88 acts upon the sequence link 90 to pivot the lazy tong link 68 about is pivotal support 72 on the seat mounting link and thereby extend the lazy tong linkage and footrest to the elevated position of FIG. 2.

The pivotal movement of the rear pivot link 44 under the weight of the occupant also moves the drive link 120 downwardly and forwardly which in turn rotates the bell crank 122 on its pivot 123 in a clockwise direction. That action of the bell crank 122 applies a force against the connecting link 128 which is fixed at its lower end on the base plate extension 130. That in turn advances the roller link from the rearward position on the tracks 32 and 34 as shown in FIG. 1 to the forward position on the tracks as shown in FIG. 2. During this sequence, the seat mounting link 55 remains essentially fixed with respect to the support link. That is, the two move together as the roller link 36 moves forward and the support link 50 swings in a forward direction as the front and rear pivot links 42 and 44 pivot counterclockwise. As a result, the seat assembly 14, comprising the seat and arm panels along with the backrest 16 which are all carried either directly or indirectly by the seat mounting link advance from the upright position shown in FIG. 1 to the TV position of FIG. 2. Simultaneously, the top of backrest 16 pivots rearwardly in a clockwise direction toward the wall behind the chair. The forward movement of the seat and arm panel assembly and the backrest by the action of the roller link and support link compensates for the change in angle of the back from closed to TV position to prevent the backrest from hitting the wall.

If the occupant in the TV position wants to place the chair in the fully reclined position of FIG. 3, he or she need only push against the backrest 16. This action causes the backrest bracket 140 to pivot on its support 142 in a clockwise direction from the position of FIG. 2 to the position of FIG. 3, and the backrest support link 144 as a result rotates the seat drive link 58 about its pivotal connection 149 on the support link 50, which advances the seat mounting link 55 with respect to the support link 50. The advancing of the seat mounting link 55 causes the seat and arm panel assembly 14 as well as the backrest 16 to move further forward on the base plate 30 to the position shown in FIG. 3. During this action, the footrest 18 remains essentially fixed with respect to the seat. The additional motion of the entire assembly away from the wall provides the room required for the backrest 16 to pivot rearwardly with respect to the seat without interference from the wall adjacent which the chair is placed.

To return the fully reclined chair to the TV or upright positions of FIGS. 2 and 1, the occupant need only relieve the pressure against the backrest 16. This will cause the seat mounting link 55 to swing rearwardly on the seat support link 56 and seat drive link 58 suspended on support link 50, and the assembly will return the position of FIG. 2. It should be appreciated that by applying the appropriate pressure against the backrest 16, the occupant may maintain the chair in any intermediate position between those shown in FIGS. 2 and 3. To proceed to the fully upright position, the occupant need only apply a downward pressure on the footrest 18, which will close the lazy tong linkage 62 and pivot the drive transfer link 88 in a counterclockwise direction about its mounting 151 on the seat mounting link, which in turn causes the front pivot link 42 to pivot clockwise and impart the same action to the rear mounting link 44. This in turn causes the drive link 120 to pivot the bell crank 122 in a counterclockwise direction and pull against the connecting link 128 and cause the roller link to travel rearwardly on the tracks 32 and 34. In this fashion, the chair moves to the fully upright position.

From the foregoing, it will be appreciated that a chair constructed in accordance with the present invention having a normal height of approximately 36 inches may be placed within one inch of the wall and will be able to move to the fully reclined position without interference. The combination of the linkage and tracks provides sufficient forward travel of the seat and backrest assembly 14 on the base plate so as to compensate for the angle change of the backrest as it moves from the upright to the TV position and on to the fully reclined position.

As noted above, the tracks used in the present invention are approximately 7 inches long and the rollers have a diameter of approximately $1\frac{3}{8}$ inches. As a result, the roller link 36 in the present invention travels only about $5\frac{3}{4}$ inches when moving between the positions shown in FIGS. 1 and 2. This short track requires substantially less power of the actuator to move the assembly to the TV and reclining positions. The shorter track also results in less wear on the rollers. Furthermore, the short travel of the support link provides a more stable platform for the chair with the resulting increased comfort for the occupant. The longer travel on tracks in the prior art chairs created a sense of instability, which was unsettling to some users. The seven inch tracks are approximately half as long as many of the tracks used in prior art devices in an effort to provide the wall clearance required of the prior art chairs.

Having described this invention in detail, those skilled in the art will appreciate that numerous modifications may be made of the invention without departing from its spirit. Therefore, it is not intended that the scope of this invention be limited to the single embodiment illustrated and described. Rather, the scope of this invention is to be determined by the appended claims and their equivalents.

What is claimed:

1. A three-way reclining chair having upright, TV and fully reclined positions including a stationary base; a seat and arm panels constituting a seat assembly fixed to one another and movable with respect to the base; a backrest movable with respect to the seat; and a linkage mechanism enabling the seat assembly and backrest to move as a unit from an upright position to a TV position and for the seat assembly and backrest to move relative to one another from the TV position to a fully reclined position; said linkage mechanism comprising a base plate on the stationary base and front and rear tracks extending fore and aft mounted on the base plate, a roller link carrying rollers mounted on the tracks so that the roller link may move fore and aft on the base plate between forwardmost and rearwardmost positions, front and rear pivot links extending upwardly from and pivotally connected to the roller link for pivotal motion thereon, a support link pivotally connected to the front and rear pivot links above the roller link and beneath the seat, a seat support link and a seat drive link pivotally connected to the support link and carrying a seat mounting link, said seat mounting link being fixed to the seat assembly beneath the seat, a footrest and lazy tong linkage carrying the footrest, said lazy tong linkage being connected to the seat mounting link for moving the footrest with respect to the seat between a first position wherein the footrest is retracted and a second position wherein the footrest is extended, a drive link connected at one end to the rear pivot link and at its other end to a bell crank pivoted intermediate its ends on the roller link, a connecting link pivotally connected at spaced points to the bell crank and to the base plate.

and a handle assembly mounted on the seat mounting link and connected to the lazy tong linkage and the front pivot link, said handle assembly when actuated extending the footrest and moving the front and rear pivot links and the support link in a forwardly direction on the roller link whereby the occupant's weight causes the front and rear pivot links and the support link to move further in a forwardly direction on the roller link and the drive link to turn the bell crank and the connecting link to push against the base plate so that the roller link moves to the forwardmost position on the base plate at the same time as the support link moves forwardly with respect to the roller link, and thereby causing the seat assembly and backrest to move from the upright position to a TV position.

2. A chair as described in claim 1 wherein a backrest bracket is pivotally connected to the seat mounting link and carries the backrest, and a back support link is connected between the seat drive link and the backrest bracket causing pressure against the backrest when the chair is in the TV position to push the seat mounting link forwardly and upwardly with respect to the base plate and the seat assembly with it to the fully reclined position while the front and rear pivot links, drive link, bell crank and connecting link remain stationary so that the support link and roller link remain fixed with respect to the base plate.

3. A chair as described in claim 2 wherein the pressure against the backrest causes the back support link to pivot the seat drive link so as to swing the seat mounting link forwardly with respect to the support link.

4. A chair as described in claim 1 wherein the linkage mechanism includes a drive transfer link pivoted on the seat mounting link and connected between the handle assembly and the lazy tong linkage, and a footrest drive link connected to the drive transfer link and the front pivot link, said drive transfer link and footrest drive link causing the pivot links to pivot forwardly and the lazy tong linkage to extend the footrest when the handle assembly is actuated.

5. A three-way reclining chair having upright, TV and fully reclined positions including a base, seat and linkage mechanism for supporting the seat for movement between upright and TV positions, said mechanism comprising a base plate on the base and a base link mounted for translational motion on the base plate between forwardmost and rearwardmost positions, a support link pivotally carried below the seat on front and rear pivot links that in turn are carried by the base link, a seat mounting link supported below the seat for swinging movement on the support link, said seat mounting link carrying the seat, a drive link connected to one of the pivot links, a bell crank mounted on the base link and connected to the drive link, a connecting link connected between the bell crank and the base plate, and an actuating linkage assembly connected to one of the pivot links for pivoting the pivot links forwardly on the base link and causing the support link to move forwardly with respect to the base link and carry the seat mounting link and seat with it and simultaneously also causing the drive link, crank and connecting link to move the base link forwardly on the base plate so as to move the support link and seat mounting link and the seat with it further forwardly with respect to the base plate as the chair moves from the upright to the TV position.

6. A reclining chair as described in claim 5 wherein a footrest and footrest linkage are mounted on the seat mounting link and movable between retracted and extend positions, said actuating linkage assembly being connected to the footrest linkage and moving the footrest to the extended position when the seat mounting link and seat move from the upright to the TV position.

7. A reclining chair as described in claim 5 wherein said base link carries rollers, and tracks for said rollers are mounted on the base plate enabling the base link to move translationally on the base plate.

8. A three-way reclining chair having a stationary base; a seat and panels constituting a seat assembly fixed to one another and movable with respect to the base; and a linkage mechanism enabling the seat assembly to move from an upright position to a TV position and from the TV position to a fully reclined position; said linkage mechanism comprising a base plate on the base and front and rear tracks extending fore and aft mounted on the base plate, a roller link carrying rollers mounted on the tracks so that the roller link may move fore and aft on the base plate between forwardmost and rearwardmost positions, front and rear pivot links extending upwardly from and pivotally connected to the roller link for pivotal motion thereon, a support link pivotally connected to the front and rear pivot links above the roller link and below the seat, a seat support link and a seat drive link pivotally connected to the support link and carrying a seat mounting link, said seat mounting link being disposed beneath the seat and fixed to and carrying the seat assembly, a footrest and lazy tong linkage carrying the footrest, said lazy tong linkage being connected to the seat mounting link for moving the footrest with respect to the seat between a first position wherein the footrest is retracted when the seat assembly is in the upright position and a second position wherein the footrest is extended when the seat assembly is in the TV and fully reclined positions, a drive link connected at one end to the rear pivot link and at its other end to a bell crank pivoted intermediate its ends on the roller link, a connecting link pivotally connected at spaced points to the bell crank and to the base plate, and a handle assembly mounted on the seat mounting link and connected to the lazy tong linkage and the front pivot link, said handle assembly when actuated simultaneously extending the footrest and moving the front and rear pivot links in a forwardly direction with respect to the roller link whereby the occupant's weight causes the front and rear pivot links to move further in a forwardly direction with respect to the roller link and the drive link simultaneously to turn the bell crank and the connecting link to push against the base plate so that the roller link moves from the rearwardmost to the forwardmost position on the tracks as the support link moves forwardly with respect to the roller link, and the seat assembly moves from the upright position to a TV position.

9. A chair as described in claim 8 wherein the linkage mechanism includes a drive transfer link pivoted on the seat mounting link and connected between the handle assembly and the lazy tong linkage, and a footrest drive link connected to the drive transfer link and the front pivot link, said drive transfer link and footrest drive link causing the pivot links to pivot forwardly and the lazy tong linkage to extend the footrest when the handle assembly is actuated.

10. A three-way reclining chair having a stationary base; a seat and arm panels constituting a seat assembly fixed to one another and movable with respect to the base; a backrest movable with respect to the seat; and a linkage mechanism enabling the seat assembly and backrest to move as a unit from an upright position to a TV position and for the seat assembly and backrest to move relative to one another from the TV position to a fully reclined position; said linkage mechanism comprising a base plate on the base and front and rear track means extending fore and aft mounted on the base plate, a base link mounted on the track means for fore and aft movement on the base plate between rearwardmost and forwardmost positions, front and rear pivot links extending upwardly from and pivotally connected to the base link for pivotal motion thereon, a support link below the seat and pivotally connected to the front and rear pivot links above the base link, a seat support link and a seat drive link pivotally connected to the support link and carrying a seat mounting link, said seat mounting link being fixed to and carrying the seat assembly, a footrest and lazy tong linkage carrying the footrest, said lazy tong linkage being connected to the seat mounting link for moving the footrest with respect to the seat between a first position wherein the footrest is retracted and a second position wherein the footrest is extended, a drive link connected at one end to the rear pivot link and at its other end to a bell crank pivoted intermediate its ends on the base link, a connecting link pivotally connected at spaced points to the bell crank and to the base plate, and a handle assembly mounted on the seat mounting link and connected to the lazy tong linkage and the front pivot link, said handle assembly when actuated extending the footrest and moving the front and rear pivot links in a forwardly direction with respect to the base link whereby the occupant's weight causes the front and rear pivot links to move further in a forwardly direction with respect to the base link, said movement of the pivot links in a forwardly direction simultaneously causing the drive link to turn the bell crank and the connecting link to push against the base plate so that the base link moves forwardly with respect to the base plate to the forwardmost position on the tracks as the support link moves forwardly with respect to the base link, and the seat assembly and backrest move from the upright position to a TV position.

11. A three-way reclining chair having a stationary base; a seat and arm panels constituting a seat assembly fixed to one another and movable with respect to the base; and a linkage mechanism enabling the seat assembly to move from an upright position to a TV position and from the TV position to a fully reclined position; said linkage mechanism comprising a base plate and front and rear tracks means extending fore and aft mounted on the base plate;

a base link mounted on the track means for fore and aft movement on the base plate between forwardmost and rearwardmost positions, front and rear pivot links extending upwardly from and pivotally connected to the base link for pivotal motion thereon, a support link disposed below the seat and pivotally connected to the front and rear pivot links above the base link, a seat support link and a seat drive link pivotally connected to the support link and carrying a seat mounting link, said seat mounting link being fixed to and carrying the seat assembly, a footrest and lazy tong linkage carrying the footrest, said lazy tong linkage being connected to the seat mounting link for moving the footrest with respect to the seat between a first position wherein the footrest is retracted and a second position wherein the footrest is extended, a drive link connected at one end to the rear pivot link and at its other end to a bell crank pivoted intermediate its ends on the base link, a connecting link pivotally connected at spaced points to the bell crank and to the base plate, and a handle assembly mounted on the seat mounting link and connected to the lazy tong linkage and the front pivot link, said handle assembly when actuated extending the footrest and moving the front and rear pivot links in a forwardly direction whereby the occupant's weight causes the front and rear pivot links to move further in a forwardly direction to move the seat assembly forwardly and to tilt rearwardly to the TV position, and simultaneously causing the drive link to turn the bell crank and the connecting link to push against the base plate so that the base link moves forwardly from the rearwardmost to the forwardmost positions on the tracks as the support link moves forwardly with respect to the base link so as to provide room for the seat assembly to move from the upright position to a TV position, said front and rear pivot links, connecting link, bell crank, drive link and base link remaining fixed as the seat assembly moves from the TV to the fully reclined position.

12. A chair as described in claim 11 wherein the linkage mechanism includes a drive transfer link pivoted on the seat mounting link and connected between the handle assembly and the lazy tong linkage, and a footrest drive link connected to the drive transfer link and the front pivot link, said drive transfer link and footrest drive link causing the pivot links to pivot forwardly and the lazy tong linkage to extend the footrest when the handle assembly is actuated.

13. A three-way reclining chair comprising a base, a base link movable translationally fore and aft on and with respect to the base between forwardmost and rearwardmost positions, a support link movable fore and aft on and with respect to the base link, a seat mounting link movable fore and aft on and with respect to the support link and carrying a seat above the support link, means including a handle assembly operatively connected to the support link for moving the support link forwardly with respect to the base link, and drive means operatively connected to the support link, base link and base for moving the base link forwardly on the base from the rearwardmost to the forwardmost positions as the support link moves forwardly on the base link to move the seat from an upright position to a reclined position.

14. A reclining chair as defined in claim 13 wherein a backrest is pivotally mounted on the seat mounting link, and means operatively connected to the backrest, support link and seat mounting link for moving the seat mounting link forwardly with respect to the support link as the backrest is pivoted rearwardly with respect to the seat to a second reclined position and as the drive means is inoperative.

15. A reclining chain as defined in claim 14 wherein a footrest is mounted on the seat for movement between a retracted and extended position with respect thereto, said means including a handle being operatively connected to the footrest to move the footrest to the extended position as the support link moves forwardly with respect to the base link.

16. A three-way reclining chair having a stationary base; a seat assembly movable with respect to the base; a backrest movable with respect to the seat; and a linkage mechanism enabling the seat assembly and backrest to move as a unit forwardly with respect to the base from an upright to a TV position, and for the seat assembly and backrest to move relative to one another as the seat assembly moves further forward with respect to the base to a fully reclined position, said mechanism comprising a base link movable translationally fore and aft on the base between forwardmost and rearwardmost positions, a support link movable fore and aft on and with respect the base link, a seat mounting link movable fore and aft on and with respect to the support link and carrying the seat assembly, an actuating assembly including a handle operatively connected to the support link for moving the support link forwardly with respect to the base link causing the seat assembly and backrest to move as a unit to the TV position, linkage means including a drive link connected to the base and base link for moving the base link forwardly on the base from its rearwardmost to the forwardmost positions in response to movement of the support link forwardly on the base link simultaneously with the movement of the support link with respect to the base link, and means including a back support link carrying the backrest and operatively connected to the seat mounting link enabling the chain occupant to push back against the backrest causing it to tilt rearwardly with respect to the seat assembly and also while the base link and support link remain stationary causing the seat mounting link to move forwardly with respect to the support link when the chain moves from the TV to the fully reclined position.

17. A chair as defined in claim 16 wherein a footrest is carried by a linkage in turn connected to the seat mounting link and the actuating assembly, said linkage elevating the footrest in response to actuation of the handle.

18. A chair as defined in claim 16 wherein tracks as provided on the base and the base link is mounted on the tracks enabling the base link to move on the base between the forwardmost and rearwardmost positions.

19. A chair as defined in claim 16 wherein pivot links are mounted on the base link and carry the support link, and said drive link is connected to one of the pivot links and causes the linkage means to move the base link on the support link in response to forward pivotal motion of said one pivot link.

20. A chair as defined in claim 18 wherein pivot links are mounted on the base link and carry the support link, and said drive link is connected to one of the pivot links and causes the linkage means to move the base link on the support link in response to forward pivotal motion of said one pivot link.

21. A chair as defined in claim 20 wherein a footrest is carried by a linkage in turn connected to the seat mounting link and the actuating assembly, said linkage elevating the footrest in response to actuation of the handle.

22. A chair as defined in claim 21 wherein said linkage means also includes a bell crank pivoted intermediate its ends to the base link and at one end to the drive link and a connecting link connected at one end to the other end of the bell crank and at its other end to the base.

* * * * *